United States Patent [19]

Malo

[11] 3,978,618

[45] Sept. 7, 1976

[54] BOX CAR ANTI-PILFERAGE DEVICE FOR PLUG DOORS

[75] Inventor: Lowell L. Malo, St. Peters, Mo.

[73] Assignee: ACF Industries, Incorporated, New York, N.Y.

[22] Filed: May 10, 1974

[21] Appl. No.: 468,855

[52] U.S. Cl. ..... 49/449; 49/218; 49/219; 292/207

[51] Int. Cl.[2] ..... E05D 15/10

[58] Field of Search ..... 49/449, 216–220; 292/59–60, 205, 207, 208, 145, 148

[56] References Cited

UNITED STATES PATENTS

| | | | |
|---|---|---|---|
| 364,456 | 6/1887 | Wesler | 292/207 X |
| 1,058,829 | 4/1913 | Wilson | 292/207 |
| 3,337,994 | 8/1967 | Olander | 49/219 |

FOREIGN PATENTS OR APPLICATIONS

| | | | |
|---|---|---|---|
| 2,111,911 | 11/1971 | Germany | 49/220 |

*Primary Examiner*—Kenneth Downey
*Attorney, Agent, or Firm*—Henry W. Cummings

[57] ABSTRACT

A box car anti-pilferage device for plug doors mounted a sufficient distance above the rail whereby the device is usually beyond the reach of thieves standing on the ground in a railroad yard. The device includes a first plate having at least one opening therein mounted upon the door, and a second, movable plate having at least one opening therein mounted upon the plug door operating rod. The second plate obtains a position adjacent but spaced from the first plate when said box car door is in closed position. A locking member is mounted upon one of the first and second plates, and is biased toward a locked position passing through the openings in the first and second plates. The locking member is manually movable from said locked position to an open position out of engagement with one of the openings. A stop maintains the locking member in the open position during initial rotation of said operating rod from a door closed position toward a door open position. A tripping device moves the locking member to a tripped position engaging a surface on one of the first and second plates. The locking member because of the bias automatically assumes the locked position engaging the openings in the plates.

12 Claims, 7 Drawing Figures

BOX CAR ANTI-PILFERAGE DEVICE FOR PLUG DOORS

BACKGROUND OF THE INVENTION

Anti-pilferage devices as proposed by AAR regulations must meet the following requirements.

The device is to be located considerably above the top of the rail so that it is difficult to reach in the yard except from a loading dock.

The device is to accept an additional locking device such as a car seal, a cable of at least ½ inch in diameter, or a lock, such as a padlock. In operation, the seal cable or lock must not be subjected to opening loads.

On a plug door, the device is to be located on the crank arm operating rod so that the crank arm cannot rotate and the door cannot be withdrawn from the closed and locked position.

In addition to the above requirements, some railroads have indicated that a self-latching feature is desirable wherein the device provides determent without a seal or lock inserted.

SUMMARY OF THE INVENTION

It therefore is an object of the present invention to provide an anti-pilferage device which substantially meets or exceeds the above requirements of the AAR regulations.

It is another object of the present invention to provide an anti-pilferage device which is self-latching.

In a railway box car plug door having a door portion and at least one vertically extending operating rod rotatably mounted on the door which is movable relative to said box door portion during opening and closing of the door, a box car anti-pilferage device is mounted on the door a sufficient distance about the rail that the device is usually beyond the reach of thieves standing on the ground adjacent the rail. The device comprises a first plate having at least one opening therein mounted upon said door portion and a second plate movable relative to the first plate having at least one opening therein mounted upon said operating arm. The second plate obtains a position adjacent to but spaced from the first plate when said box car door is in closed position. A locking member is mounted upon one of the said first and second plates. The locking member is biased such that in locked position it passes through the opening in the first plate and the opening in the second plate. The locking member is manually movable from the locked position to an open position out of engagement with one of said openings. Stop means are provided for maintaining said locking member in the open position during initial rotation of the operating rod from a door closed position toward a door open position. Tripping means are mounted upon the box car door portion or the operating arm adapted to move said locking member to a tripped position engaging a surface on one of said first and second plates. Because of the bias, the locking member automatically assumes the locked position engaging said first and second openings when the second plate assumes the closed position. The biasing means may be a resilient device or gravity. If the biasing means is a resilient device, the resilient device may be mounted between either one of the first and second plates and a third plate mounted on the door or the operating arm.

THE DRAWINGS

DESCRIPTION OF PREFERRED EMBODIMENTS

Figure 1:
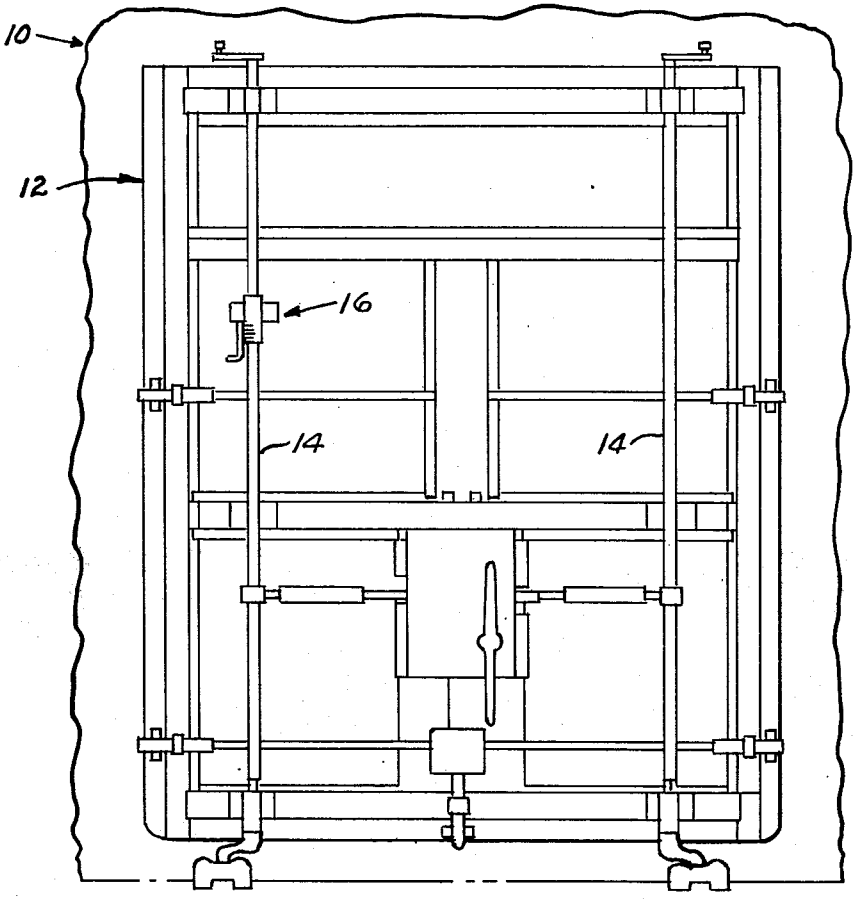
FIG. 1 is a side elevational view of a box car having a plug door and an anti-pilferage device according to the present invention.
Figure 2:
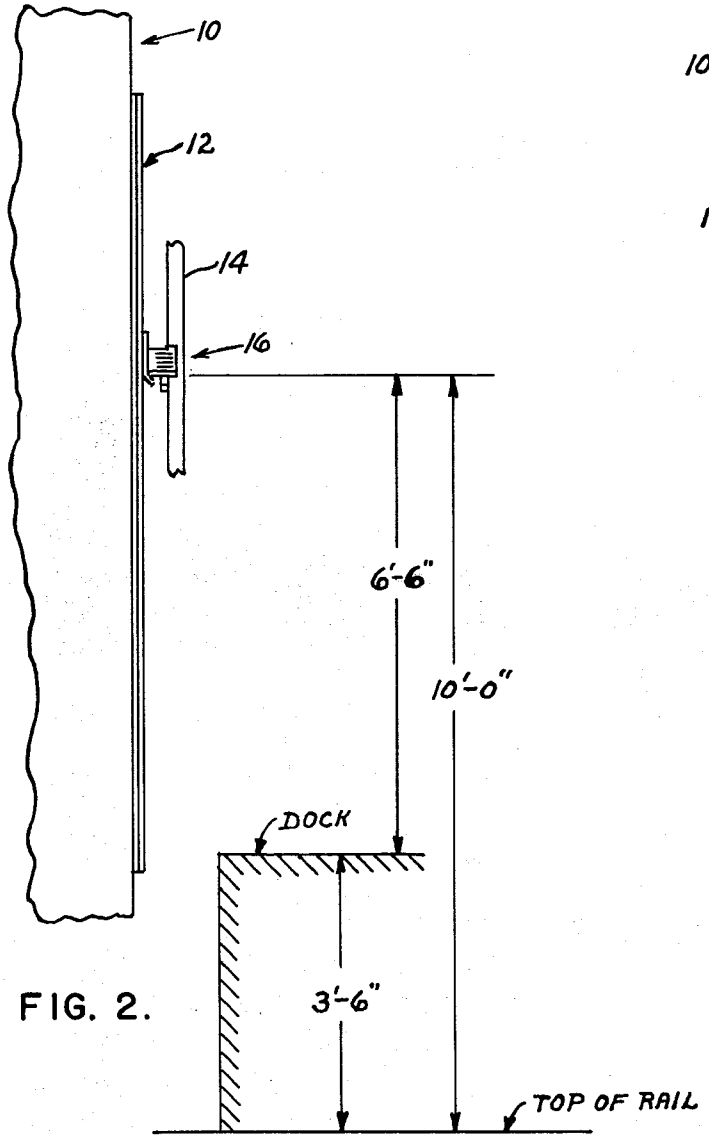
FIG. 2 is an end view of the box car and illustrating a loading and unloading dock.

In FIG. 1 a railway box car 10 is provided with a plug door 12. Plug door 12 is of conventional construction and is provided with the usual operating rods 14 having conventional crank arms. One or both of the operating rods 14 is provided with the anti-pilferage device of the present invention indicated generally in the drawings at 16 at a substantial distance above the rail, preferably at least about 10 feet. Thus, as shown in FIG. 2, the device can be reached by an operator from loading docks which are usually of the order of 3½ feet above the rail. However, the device cannot be reached without additional equipment when the car is sitting in the rail yard.

Figure 3:
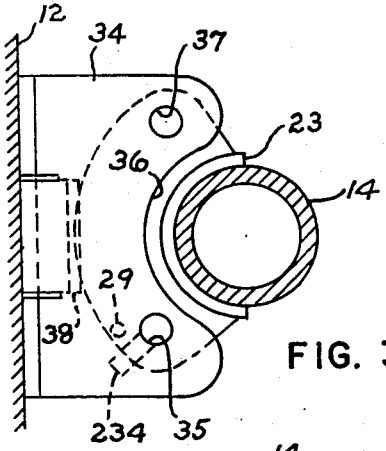
FIG. 3 is a top view of one embodiment of the anti-pilferage device of the present invention.
Figure 5B:
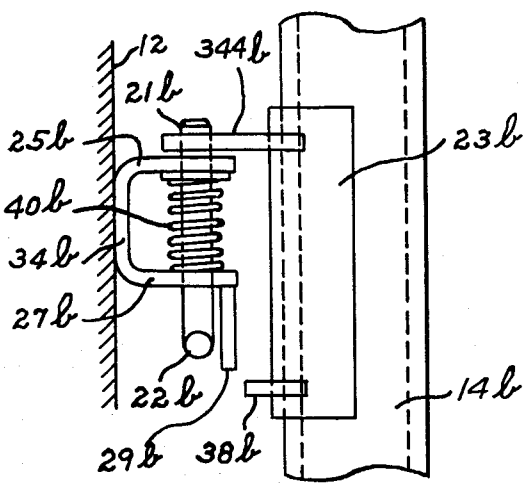
FIG. 5B is a side elevational view of an alternative embodiment of the invention shown in FIGS. 3–5 with the locking pin assembly mounted upon the door rather than upon the operating arm.
Figure 5:
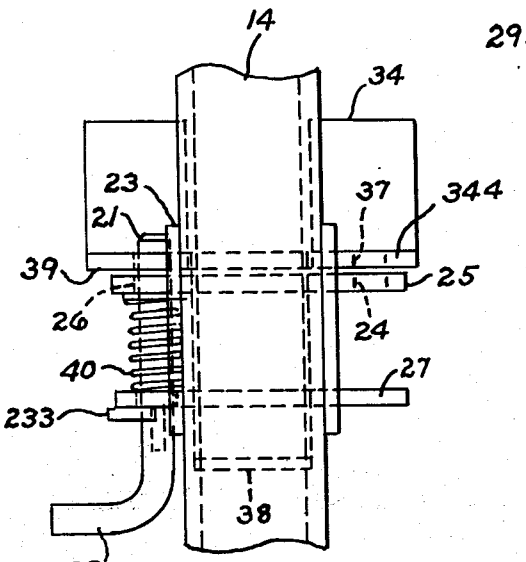
FIG. 5 is a front elevational view of the anti-pilferage device of the present invention.
Figure 4:
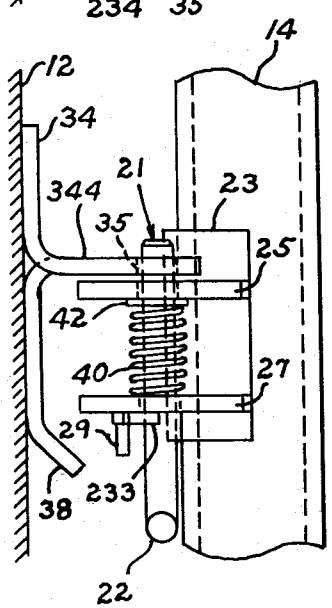
FIG. 4 is a side elevational view of the anti-pilferage device of the present invention.

In the embodiment of the present invention shown in FIGS. 3–5, a curved plate 23 is affixed with fasteners or welded to operating rod 14. Movable plates 25 and 27 are then affixed with fasteners or welded to curved plate 23. A fixed plate 34 having a horizontal portion 344 and preferably having a curved contour 36 is affixed with fasteners or welded to car door 12. Plate 34 further has an extension 38 extending outwardly from the car door. Plate 27 is provided with a generally vertical retainer 29. A locking member indicated generally at 20, particularly a locking pin 21 having a handle or extension 22 and an idler arm 233 is mounted between plates 25 and 27. A spring 40 is also mounted between plates 25 and 27 by means of a retainer ring 42 and urges locking pin 21 into the locked position in aligned openings 35 and 26 respectively, in plates 34 and 25. Plates 34 and 25 also have openings 37 and 24 which align as shown in FIG. 5.

In operation, when the door is in the closed position, when locking pin 21 is positioned within holes 35 and 26 in plates 34 and 25 respectively, the pin is in shear when one attempts to open the door. Since pin 21 assumes the load, a seal or lock located through holes 24 and 37 in plates 34 and 25 is not subjected to a load, thereby satisfying one AAR requirement.

To open the door, the lock seal or cable is removed from holes 24 and 37. Locking pin 21 is retracted by grasping handle or extension 22 and pulling downward. Pin 21 is then held in the downward position by rotating the idler arm 233 so that it rests on retainer 29. The door may now be opened in the usual manner.

When locking pin 21 is retracted, spring 40 is preloaded in compression and is held in that mode by idler arm 233 resting on retainer pin 29. When the door is opened, the crank operating rod 14 rotates clockwise in FIG. 3 until idler arm 233 comes in contact with plate extension 38. Further rotation of the crank operating rod 14 causes plate extension 38 to exert pressure on idler arm 233 until it rotates and releases pin 21 from retainer 29.

The spring 40 in compression moves locking pin 21 upward but since plates 34 and 25 have been displaced relative to each other, holes 35 and 26 no longer align. Locking pin 21 therefore rides on the lower surface 39 of plate 34.

When the door is closed, operating rod 14 rotates (counterclockwise in FIG. 3) until holes 26 and 35 in plates 34 and 25 align. Locking pin 21 under load from spring 40 automatically moves upward into the locked position in opening 35.

Any attempt to open the doors places locking pin 21 in shear and thereby provides a deterrent. An additional locking device, such as a padlock, seal or cable, may be placed through aligned openings 37 and 24 in plates 34 and 25.

For assembly purposes, plates 25 and 27 can either be welded directly to operating rod 14 or can be subassembled to plate 23. The latter technique provides a means by which this device can be easily applied to existing cars.

Idler arm 233 and pin extension 22 may be integral or be one and the same piece.

Figure 5A:
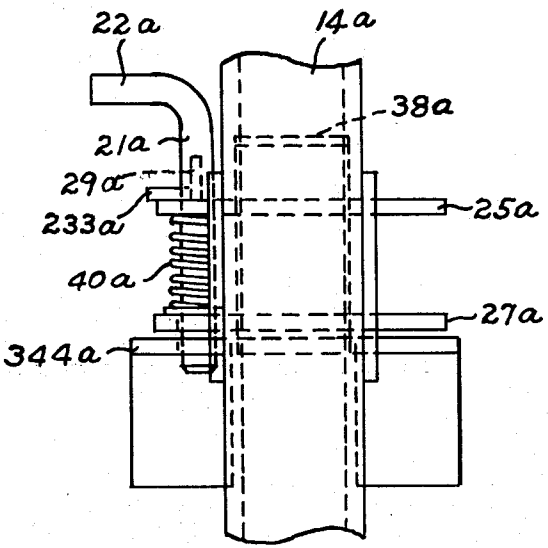
FIG. 5A is a front elevational view of an alternative embodiment of the invention as shown in FIGS. 3—5 with the locking pin inverted.

It is readily apparent that this locking device can be applied in many different ways. For example, the device can be inverted so that the locking pin moves downward to lock as shown in FIGS. 5A. Thus locking pin handle 22*a* of pin 21*a* is orientated above plate 25*a*. In order to open the door, pin 21*a* is moved upwardly in FIGS. 5A and idler arm 233*a* engages retainer 29*a*. In so doing the locking pin moves out of the opening in plate 344*a* (mounted on the door). Then as the door is opened tripping member 38*a* engages idler arm 233*a* and the other end of locking pin rides along the surface of plate 344*a* to the open position. When the door is closed, locking pin 21*a* will automatically snap into the opening in plate 344*a* under the bias of spring 40*a* held in place by plates 25*a*, 27*a* and retainer 42*a* and/or gravity. An additional locking device may then be placed through openings 24*a* and 37*a*.

Alternatively, the pin locking assembly can be applied to the door 12 rather than operating arm 14*b* as shown in FIG. 5B. Thus in the embodiment shown in FIG. 5B plates 25*b* and 27*b* are mounted upon the door 12. Spring 40*b* is held in position by plates 25*b* and 27*b* and spring retainer 42*b*. Plate 344*b* is mounted on operating arm 14*b*. To open the door locking pin 21*b* is pulled downwardly by means of handle 22*b* to engage pin retainer 29*b*. As the door is opened trip member 38*b* engages handle 22*b* and plate 344*b* rides along the upper surface of pin 21*b*. When the door is closed pin 21*b* will automatically snap into the opening in plate 344*b* when the same aligns with the pin. An additional locking device, such as a car seal, padlock, or chain, may be placed in a second set of aligned openings (not shown) in plates 25*b* and 344*b*.

What is claimed is:

1. A box car plug door anti-pilferage device comprising:

a fixed locking plate mounted upon the plug door and having a locking portion extending outwardly from said door toward the operating arm of a plug door; tripping means also mounted on said plug door and being vertically spaced from said locking portion, said fixed locking plate having a first opening adapted to receive an additional locking device and a second opening adapted to receive a locking pin; a movable locking plate mounted upon said plug door operating arm also having a first opening adapted to align with the first opening in said fixed locking plate and adapted to receive a portion of said additional locking device, and having a second opening adapted to align with the second opening in said fixed plate and adapted to receive a locking pin; a locking retainer plate mounted upon said plug door operating arm having an opening therein adapted to align with the second opening in said fixed locking plate and the second opening in said movable locking plate; said movable retainer plate having a vertical extension; means urging a locking pin having an idler arm toward the second opening in said fixed and movable locking plate whereby said additional locking member is adapted to be removed from the first opening in said fixed locking plate and in said movable locking plate, and said locking pin is adapted to be manually moved out of said second openings in said fixed locking plate and movable locking plate and held out of engagement by engagement of the locking pin idler arm with the vertical extension on said retainer plate, and whereby said tripping member is adapted to disengage said locking pin idler arm from said retainer extension and permit said locking pin to ride upon a surface of said fixed locking plate and whereby when said plug door is rotated into the closed position said second openings in said fixed and movable plates will align and said locking pin will automatically move into said second openings and said first openings in said fixed and movable plates will align and be adapted to receive a padlock, seal or cable.

2. An anti-pilferage device according to claim 1 wherein said movable locking plate and said retainer plate are integrally affixed to a curved plate which curve plate in turn is integrally affixed to said operating arm.

3. In a railway box car plug door having a door portion and at least one vertically extending, operating rod rotatably mounted on the door which is movable relative to said door portion during opening and closing of the door; the improvement comprising a box car anti-pilferage device mounted on the door a sufficient distance above the rail whereby the device is usually beyond the reach of thieves standing on the ground adjacent the rail, the device comprising:

a first plate mounted upon said door portion, said first plate having at least one first plate opening therein; a second plate having at least one second plate opening therein mounted upon said operating rod; said second plate obtaining a closed position adjacent to but spaced from said first plate when said box car door is in closed position; a locking member mounted upon one of said first and second plates; said locking member in locked position passing through said first and second plate openings; biasing means biasing said locking member into said locked position; said locking member being manually movable from said locked position against the bias of said biasing means to an open position out of engagement with one of said first and second plate openings into engagement with retaining means for retaining said locking member in said open position during initial rotation of said operating rod from a door closed position toward a door open position; and tripping means mounted upon one of said door portion and operating rod adapted to move said locking member to a tripped position engaging a surface on one of said first and second plates; said locking member under the action of said biasing means automatically assuming said locked position engaging said first and second plate openings when said second plate assumes said closed position.

4. An anti-pilferage device according to claim 1 wherein said biasing means comprises a resilient means.

5. An anti-pilferage device according to claim 1 wherein said biasing means comprises gravity.

6. An anti-pilferage device according to claim 1 wherein said locking member comprises a locking pin.

7. An anti-pilferage device according to claim 1 in which said first plate and said second plate each comprise additional openings which align when said box car door assumes said closed position, which openings are adapted to receive an additional railway car locking device.

8. An anti-pilferage device according to claim 1 wherein said locking member is mounted on said first plate.

9. An anti-pilferage device according to claim 1 wherein said locking member is mounted upon said second plate.

10. An anti-pilferage device according to claim 2 wherein said resilient means comprises a spring mounted in biased position between one of said first and second plates, and a third plate mounted on one of said door portion and said operating rod.

11. An anti-pilferage device according to claim 8 wherein said second plate and said third plate are mounted on said operating rod, and said spring is mounted therebetween.

12. An anti-pilferage device according to claim 8 wherein said first plate and said third plate are mounted on said door portion and said spring is mounted therebetween.

* * * * *